US007575409B2

(12) United States Patent
Dierksmeier et al.

(10) Patent No.: US 7,575,409 B2
(45) Date of Patent: Aug. 18, 2009

(54) APPARATUS AND METHOD FOR ACTIVE CONTROL OF BLADE TIP CLEARANCE

(75) Inventors: Douglas David Dierksmeier, Franklin, IN (US); Tab Michael Heffernan, Plainfield, IN (US)

(73) Assignee: Allison Advanced Development Company, Indianapolis, IN (US)

( * ) Notice: Subject to any disclaimer, the term of this patent is extended or adjusted under 35 U.S.C. 154(b) by 577 days.

(21) Appl. No.: 11/173,345

(22) Filed: Jul. 1, 2005

(65) Prior Publication Data

US 2007/0020095 A1 Jan. 25, 2007

(51) Int. Cl.
*F01D 25/24* (2006.01)

(52) U.S. Cl. ..... 415/1; 415/126; 415/173.1

(58) Field of Classification Search ..... 415/173.1, 415/173.2, 174.1, 126, 128, 214.1, 118, 1
See application file for complete search history.

(56) References Cited

U.S. PATENT DOCUMENTS

| | | | |
|---|---|---|---|
| 3,085,398 | A | 4/1963 | Ingleson |
| 4,127,357 | A | 11/1978 | Patterson |
| 4,330,234 | A | 5/1982 | Colley |
| 4,720,237 | A | 1/1988 | Weiner et al. |
| 4,844,688 | A | 7/1989 | Clough et al. |
| 5,018,942 | A | 5/1991 | Ciokajlo et al. |
| 5,049,033 | A | 9/1991 | Corsmeier et al. |
| 5,056,988 | A | 10/1991 | Corsmeier et al. |
| 5,096,375 | A | 3/1992 | Ciokailo |
| 5,104,287 | A | 4/1992 | Ciokajlo |
| 5,211,534 | A | 5/1993 | Catlow |
| 5,263,816 | A | 11/1993 | Weimer et al. |
| 5,545,007 | A | 8/1996 | Martin |
| 5,601,402 | A | 2/1997 | Wakeman et al. |
| 5,871,333 | A | 2/1999 | Halsey |
| 6,273,671 | B1 | 8/2001 | Ress, Jr. |
| 6,607,350 | B2 | 8/2003 | Dodd |
| 6,692,222 | B2 | 2/2004 | Prinz et al. |
| 2003/0012644 | A1 | 1/2003 | Dodd |
| 2003/0215323 | A1 | 11/2003 | Prinz et al. |

*Primary Examiner*—Ninh H Nguyen
(74) *Attorney, Agent, or Firm*—Krieg DeVault LLP; Matthew D. Fair, Esq.

(57) ABSTRACT

An active blade clearance control system for a gas turbine engine. The clearance between the tip of a rotatable blade and an inner surface of a blade track is adjusted by moving the blade track relative to the tip of the blades. A split control ring is manipulated to adjust tension therein and a resulting force is transmitted to an inner member. The plurality of blade tracks are coupled to the inner member and move in response to the force transmitted from the split control ring.

20 Claims, 8 Drawing Sheets

APPARATUS AND METHOD FOR ACTIVE CONTROL OF BLADE TIP CLEARANCE

FIELD OF THE INVENTION

The present invention relates generally to controlling blade tip clearance within gas turbine engines. More specifically, in one aspect the present invention relates to an active blade tip clearance control system utilizing an actuator and control ring to adjust the position of a plurality of blade tracks relative to the tip of a gas turbine engine blade.

BACKGROUND

A gas turbine engine is typical of the type of machinery in which the invention described herein may be advantageously employed. It is known that a gas turbine engine conventionally comprises a compressor for compressing inlet air to an increased pressure for delivery to a combustion chamber. A mixture of fuel and the increased pressure air is burned in the combustion chamber to generate a high temperature gaseous flow-stream from which work is extracted by a plurality of rotatable turbine blades within a turbine.

In an effort to reduce the specific fuel consumption of gas turbine engines, there has been a move to increase the turbine efficiency by decreasing the clearance between the turbine blade tips and the non-rotating blade track. In designing a gas turbine engine with tighter blade tip clearances, designers must account for transient conditions that many gas turbine engine experiences during operation. During acceleration of the gas turbine engine, the rotor carrying the turbine blades experiences mechanical growth in a radial direction faster than the blade track, thereby allowing the potential for mechanical contact between the blade tips and the blade track. During deceleration of the gas turbine engine, the blade tracks exhibit mechanical shrinkage in the radial direction more quickly than the rotor, thereby allowing the potential for mechanical contact between the blade tips and the blade tracks.

The present invention provides a novel and non-obvious method and apparatus for controlling the blade tip clearance in a gas turbine engine.

SUMMARY

One form of the present invention contemplates an apparatus comprising: a mechanical housing; an annular member coupled to and disposed within the mechanical housing, the annular member including an actuatable portion; a plurality of blade tracks coupled to and moveable with the actuatable portion, each of the plurality of blade tracks having an inner surface that comprises a portion of a fluid flow path; a rotatable structure including a plurality of blades disposed within the fluid flow path, each of the plurality of blades having a blade tip spaced from the inner surface of the plurality of blade tracks to define a blade tip clearance; and a split band located within the mechanical housing and extending around the annular member, the split band operable to move the actuatable portion and change the blade tip clearance.

Another form of the present invention contemplates an apparatus comprising: a mechanical housing; an annular member coupled to and disposed within the mechanical housing, the annular member including a segmented portion positioned between a fore hoop continuous portion and an aft hoop continuous portion; a plurality of blade tracks coupled to and moveable with the segmented portion, each of the plurality of blade tracks having a surface that defines a portion of a working fluid flow path; a rotatable structure including a plurality of blades disposed within the working fluid flow path, each of the plurality of blades having a blade tip spaced from the surface of the plurality of blade tracks to define a blade tip clearance; a split control ring located within the mechanical housing and extending around the annular member; at least one actuator coupled with the mechanical housing and the split control ring; a plurality of load transfer members located between and abutting the annular member and the split control ring; and, the at least one actuator being operable to place the split control ring in tension and transmit a force through the plurality of load transfer members to the segmented portion and move the segmented portion and the plurality of blade tracks.

In yet another form the present invention contemplates an apparatus comprising: a gas turbine engine case; a plurality of blade tracks disposed within the engine case, each of the plurality of blade tracks having a surface defining a portion of a working fluid flow path; a rotatable structure including a plurality of blades disposed within the working fluid flow path, each of the plurality of blades having a blade tip spaced from the surface to define a clearance; an actuator; and, means for supporting and changing the location of the plurality of blade tracks to adjust the clearance between the blade tips and the blade tracks, the means being operatively coupled and actively controlled by the actuator.

In yet another form the present invention contemplates a method for controlling blade tip clearance within a gas turbine engine. The method comprising: determining a clearance between a tip of a blade and a surface defining a portion of a working fluid flow path; adjusting the tension in a split control ring located within the gas turbine engine; transmitting a force from the split control ring to a discontinuous annular member; moving at least a portion of the discontinuous annular member from a first position to a second position in response to the transmitting act; and, changing the position of a plurality of blade tracks in response to the moving act.

DESCRIPTION OF THE ILLUSTRATIVE EMBODIMENTS

Figure 1:
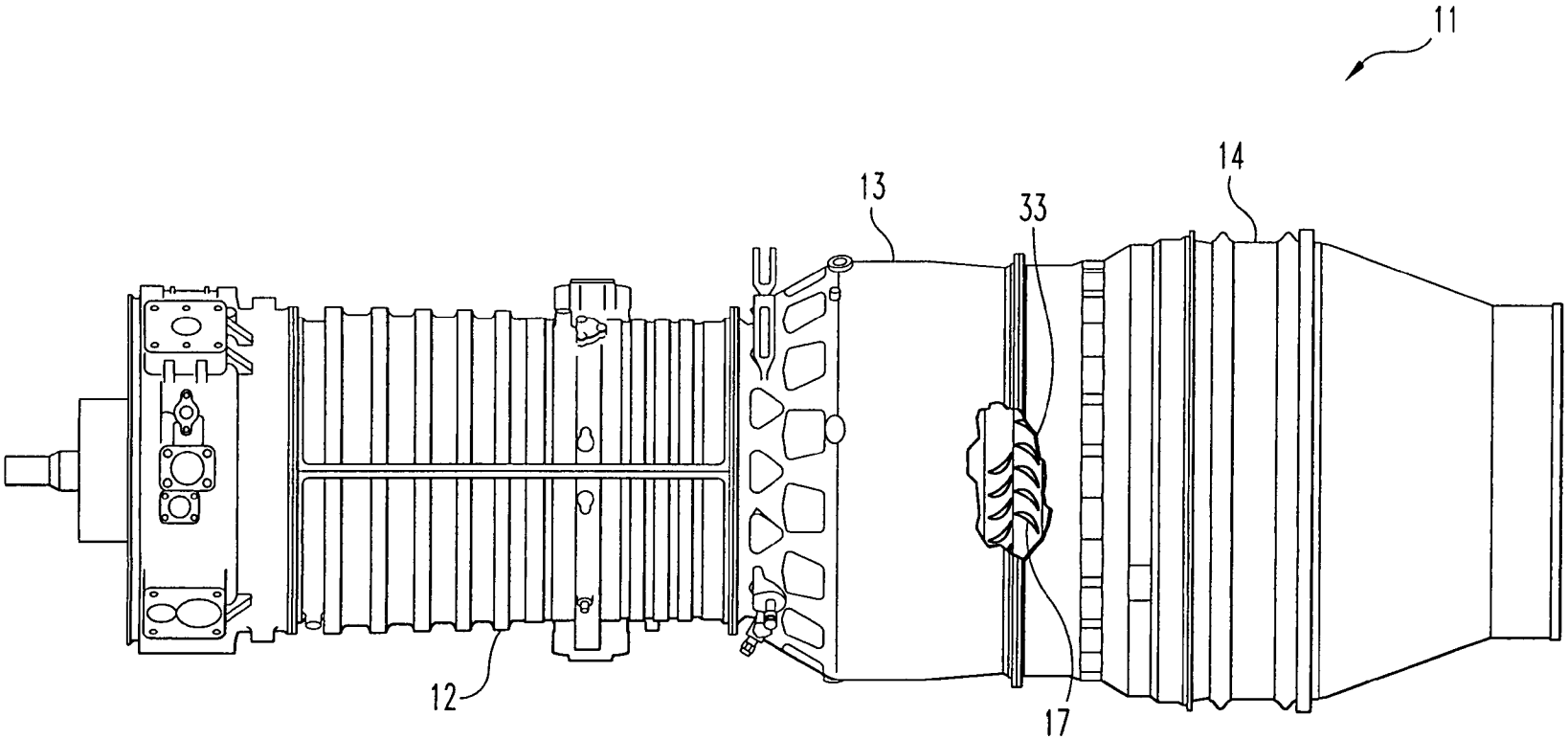
FIG. 1 is a partially fragmented side elevational view of a gas turbine engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Referring to FIG. 1, there is illustrated an exemplary non limiting example of a gas turbine engine 11. The present application contemplates a broad variety of gas turbine engines and is not intended to be limited to the engine depicted in FIG. 1, unless specifically provided to the contrary. In one form gas turbine engine 11 includes a compressor section 12, a combustor section 13 and a turbine section 14. The gas turbine engine 11 includes a rotor disk 17 with a plurality of turbine blades 33. Rotor 17 with the plurality of turbine blades 33 is coupled to and rotates with a shaft (not shown) located within gas turbine engine 11. The engine depicted in FIG. 1 is merely one example of a gas turbine engine and it is understood that there are a variety of ways that components, including the addition of other components or utilization of fewer components, may be linked together or arranged.

A gas turbine engine may find application in all types of aircraft, including for example, helicopters, fixed wing planes, tactical fighters, trainers, missiles and other related apparatus. Gas turbine engines are equally suited to be used for a wide variety of industrial applications on land and/or sea. Historically, there has been widespread application of industrial gas turbine engines, such as pumping sets for gas and oil transmission lines, electricity generation and naval/sea propulsion. Further, gas turbine engines are also utilized in land based vehicles and hovercrafts.

Figure 2:
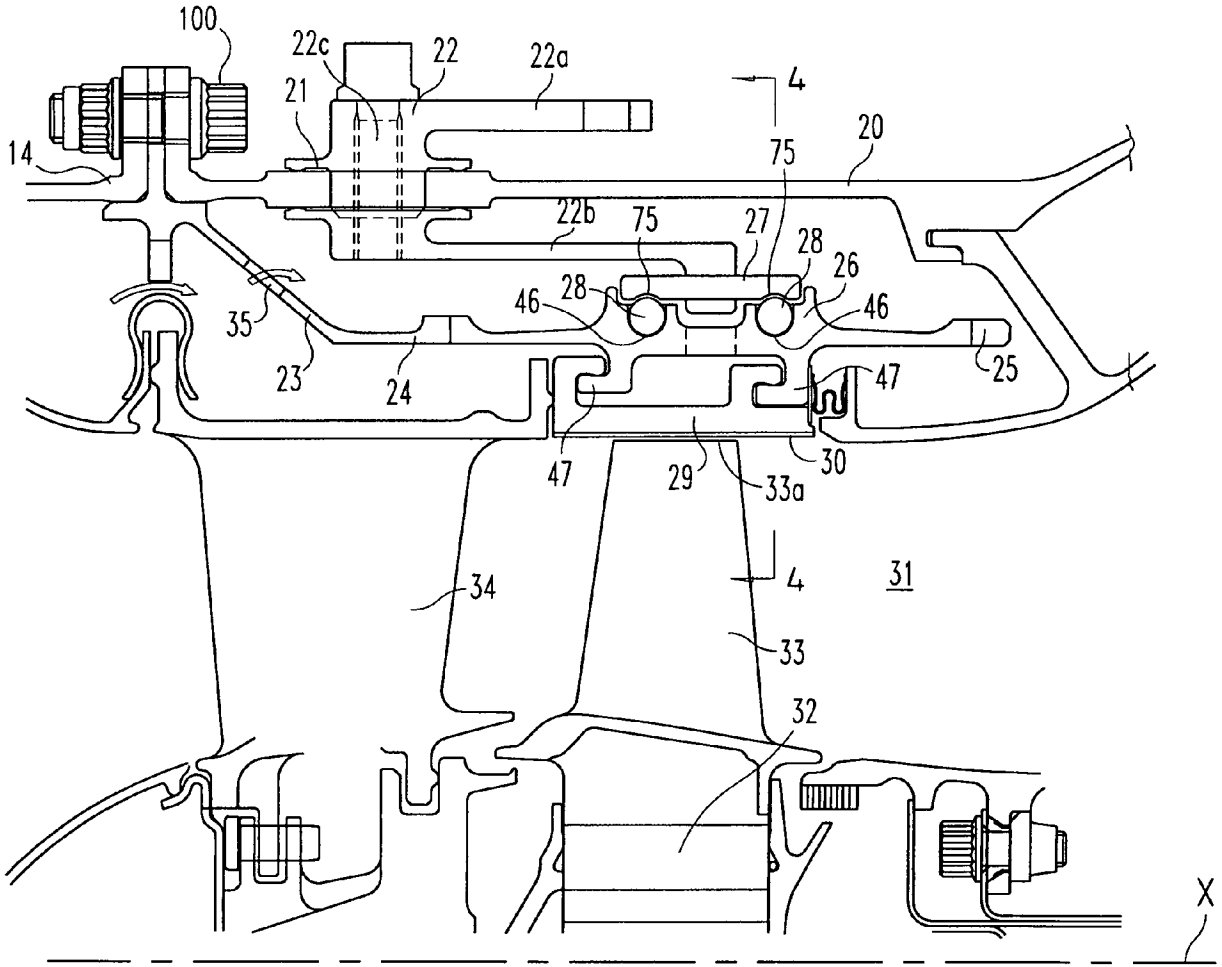
FIG. 2 is a sectional view of a portion of a gas turbine engine comprising one embodiment of an active blade tip clearance control system of the present invention.

With reference to FIG. 2, there is illustrated a cross sectional view of a portion of turbine section 14. The present inventions will be described with reference to turbine section 14; however, the present invention is also applicable within compressor section 12 unless specifically provided to the contrary. The plurality of turbine blades 33 are exposed to a hot gaseous exhaust flow passing from the combustor section 13. Located upstream from the plurality of turbine blades 33 is a plurality of vanes 34.

Turbine section 14 includes an outer case/mechanical housing 20. Outer case/mechanical housing 20 has at least one hole 21 formed therein for the mounting of an actuator 22. In one form of the present invention there are a pair of spaced apart holes 21 (FIG. 4) formed in the outer case/mechanical housing 20 for receiving a pair of actuators 22. Each of the actuators 22 includes a connecting arm 22*a* and an actuation arm 22*b*. In one form, connecting arm 22*a* is joined to actuation arm 22*b* through a shaft 22*c*. The movement of connecting arm 22*a* by an actuator mechanism 60 (FIG. 6) is transferred to actuation arm 22*b* through the shaft 22*c*. Arms 22*a* and 22*b* are moveable relative to the outer case/mechanical housing 20. Other types of actuators 22 are contemplated herein and the present invention is not intended to be limited to the actuator set forth in the figures unless specifically provided to the contrary.

An inner structure 23 is disposed radially inward from outer case/mechanical housing 20. In one form, inner structure 23 is an annular structure defined by an annular inner case/mechanical housing.

The inner structure 23 is preferably symmetric about a center line X. Inner structure 23 is coupled to outer case/mechanical housing 20, and in one form is held in place by a plurality of fasteners 100. In one form, inner structure 23 includes a plurality of spaced fluid flow holes 35. The fluid flow holes 35 allow the passage of a cooling fluid through portions of inner structure 23. Inner structure 23 includes a continuous portion and a discontinuous portion. In one form, the continuous portion comprises a fore hoop continuous portion 24 and an aft hoop continuous portion 25 with the discontinuous portion defined by a segmented portion 26 disposed therebetween. In another form, the hoop continuous portion 25 is eliminated.

Figure 3:
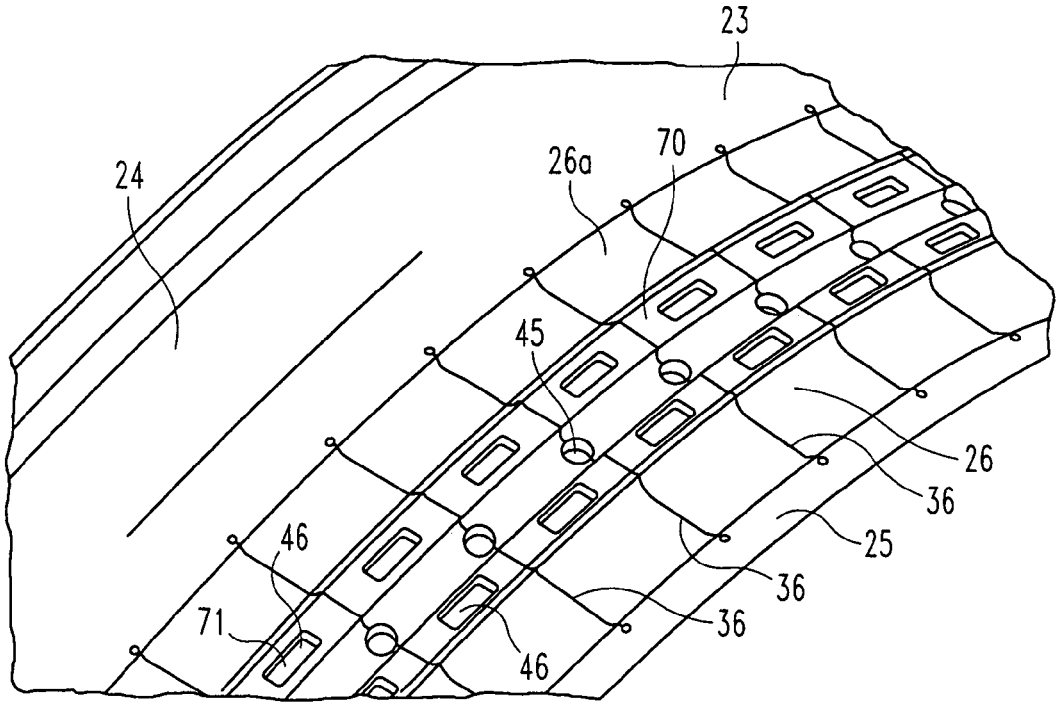
FIG. 3 is a partial perspective view illustrating one embodiment of an inner structure comprising a portion of the active blade tip clearance control system of FIG. 2.

With Reference to FIG. 3, there is illustrated one embodiment of inner structure 23 including fore hoop continuous portion 24, aft hoop continuous portion 25 and discontinuous portion 26. Discontinuous portion 26 includes a plurality of members 26*a* separated from one another at joints 36. In one form, the size and spacing of the plurality of members 26*a* is substantially constant around the circumference of discontinuous portion 26. However, in another form the size of the gaps at joints 36 and/or size of the members 26*a* varies about the circumference of the discontinuous portion 26. The plurality of members 26*a* can be formed by cutting joints 36 in inner structure 23. It should be understood that the division of discontinuous portion 26 into individual members 26*a* may be created by other techniques known to those of ordinary skill in the art.

In segmented portion 26, the plurality of members 26*a* are adapted to be moved radially by the application of and/or removal of a load applied thereto. The movement of the plurality of members 26*a* is in an elastic mode and they will each return to their steady state position upon removal of the external load. On a relative basis discontinuous portion 26 is flexible in comparison to continuous portions 24 and 25. In one form of the present invention, there are 60 members 26*a* spaced around the circumference of inner structure 23. However, other numbers of members are contemplated herein. The inner structure may be formed of an elastic high temperature material such as, but not limited to, IN 718 in a cast or wrought form.

In one form, inner structure 23 includes at least one aperture 45 to allow the passage of a portion of a probe (not illustrated) therethrough. In another form, inner structure 23 includes a plurality of circumferentially spaced apertures 45 to allow for the passage of cooling air therethrough in addition to the passage of one or more probes. Further, formed in surface 70 of discontinuous portion 26 is a plurality of slots/races 46 for the receipt of one of the plurality of load transfer members 28 (FIG. 2). In one form, slots/races 46 are generally rectangular in shape and extend in a circumferential direction. Each of the slot/races 46 are sized to receive at least one of the plurality of load transfer members 28 and preferably are dished on the lower surface 71 to increase the contact area with load transfer members 28. More specifically, the dished portion defines a concave surface that substantially matches the curvature of load transfer members 28. In a preferred form, load transfer members 28 are rolling element balls and in a more preferred form they are rolling element ceramic balls. In one form, the rolling element ceramic balls are formed of silicon nitride.

Referring back to FIG. 2, there is illustrated that inner structure 23 may include a plurality of circumferential extending blade track retention hooks 47. Blade track retention hooks 47 provide a means for coupling a plurality of blade track segments 29 to discontinuous portion 26 of inner structure 23. Blade track segments 29 as utilized herein are intended to be read broadly and include, but are not limited to, blade tracks, shrouds and blade outer air seals. Each of the blade track segments 29 has an inner surface 30 that forms a portion of the working fluid flow path 31. The blade track segments 29 form a circumferential inner surface that is normally spaced radially from tips 33*a* of turbine blades 33. However, it should be understood that a person of ordinary skill in the art will recognize that transient rubs are possible between tips 33*a* of turbine blades 33 and inner surface 30 of blade track segments 29. In one form, the number of blade track segments is 30; however other quantities are contemplated herein.

The turbine blades 33 are coupled to a mechanical structure 32 such as, but not limited to, a wheel or rotor that is rotatable about centerline X. The turbine engine blades 33 may be integrally cast or forged with the mechanical structure 32 or alternatively can be assembled and mechanically connected to form a rotatable assembly. The turbine blades 33 and/or rotatable structure 32 may be formed of wrought, and/or cast and/or machined components. In one form, the components are formed of an alloy and in a preferred form are single crystal nickel based superalloy components. The turbine blades 33 are located in turbine section 14 and therefore are exposed to the hot exhaust flow from the combustor section 13. Located upstream of the plurality of turbine blades 33 is the plurality of vanes 34.

A split control member 27 is disposed around discontinuous portion 26 of inner structure 23. In one form, split control member 27 is defined by a split ring or split band. One form of the split control member 27 includes a plurality of spaced load transfer member receiving slots/races 75 adapted for receiving at least one of the plurality of load transfer members 28. The load transfer members 28 are disposed substantially within slots/races 46 in inner structure 23 and slots/races 75 in split control member 27. As discussed previously, load transfer members 28 are rolling element balls and in a preferred form are ceramic balls. In one form, each of the load transfer member receiving slots/races 75 is dished to increase the contact area with load transfer member 28. Dishing of the portion of the receiving slot/race 75 defines a concave surface that substantially matches the curvature of load transfer members 28. The split control member 27 is mechanically coupled to the pair of actuating arms 22*b* so that that actuation of the actuators 22 will result in the movement of actuating arms 22*b* and the split control member 27.

Figure 4:
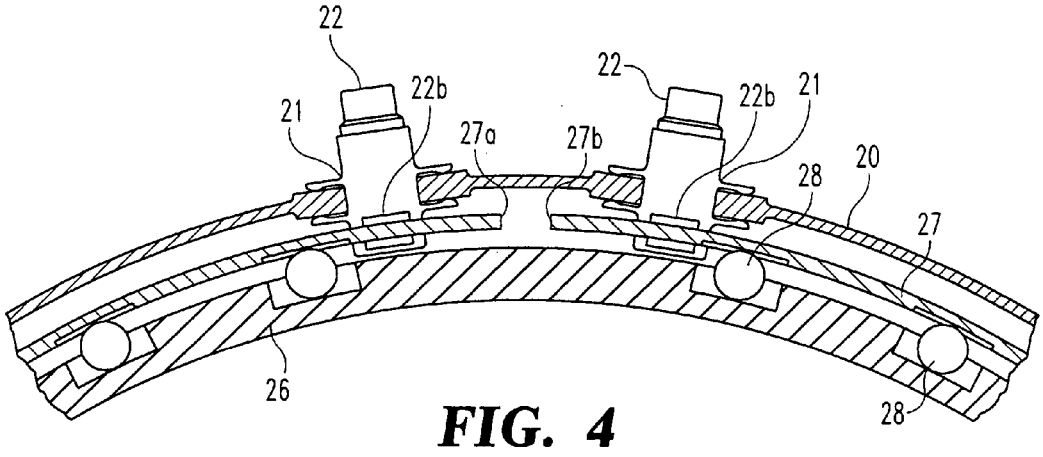
FIG. 4 is an illustrative sectional view of a portion of one embodiment of an active blade tip clearance control system comprising an actuating member and a plurality of load transfer members.
Figure 4A:
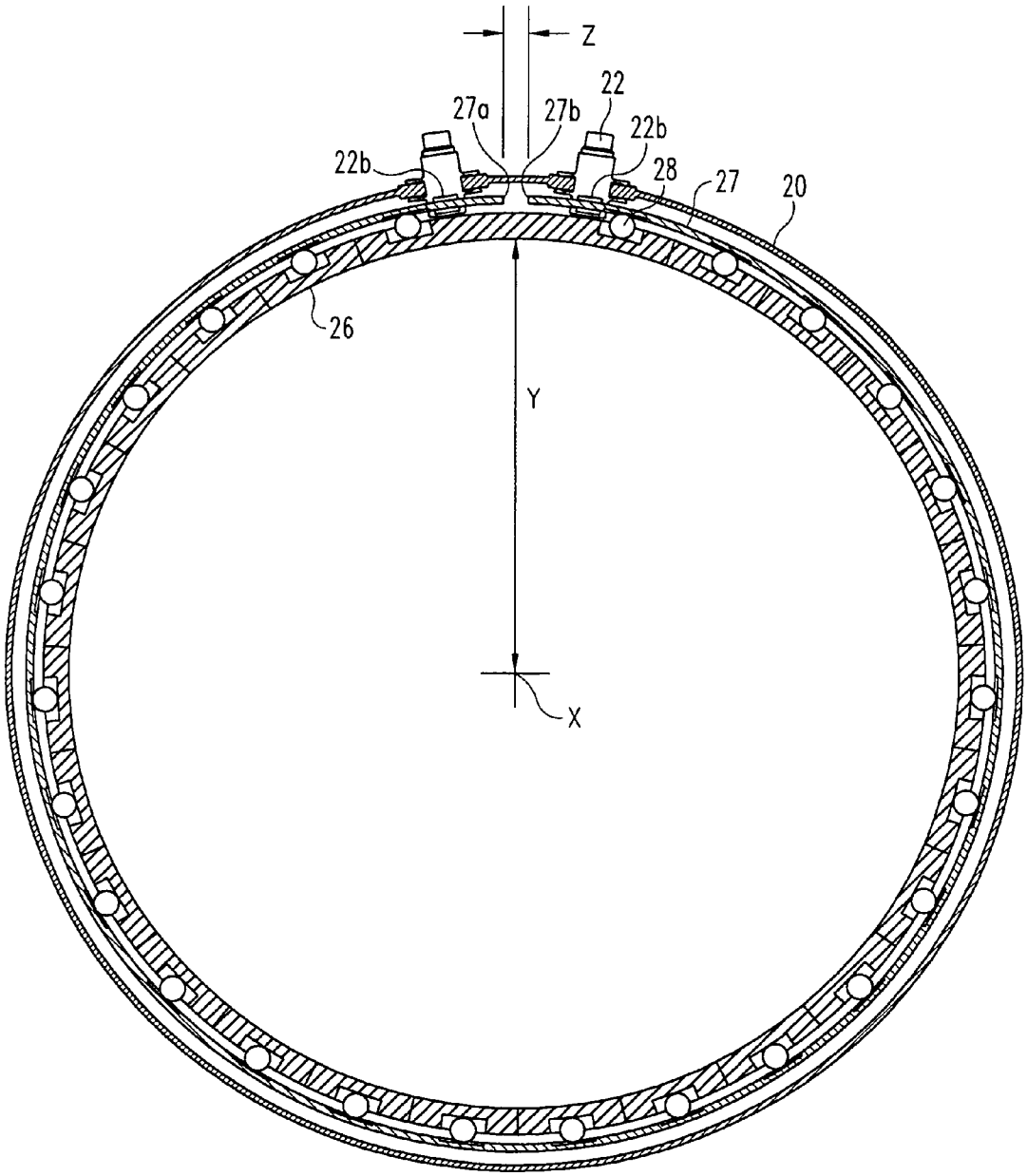
FIG. 4*a* is an illustrative sectional view of one embodiment of an active blade tip clearance control system of the present invention.

With reference to FIGS. 4 and 4*a*, there is illustrated the relationship between actuating arms 22*b* and split control member 27. In one aspect, as actuating arms 22*b* are moved the ends 27*a* and 27*b* of split control member 27 are brought closer together or spread further apart thereby increasing or decreasing the effective circumference of split control member 27. The view in FIG. 4 has been simplified in order to further facilitate ones understanding of the present invention. The change in the effective circumference of split control member 27 results in the increase or decrease in the tension in split control member 27 and thereby changes the force transmitted through the plurality of load transfer members 28 to inner structure 23. The discontinuous portion 26 of inner structure 23 and the plurality of blade track segments 29 move together. Therefore, as the tension in split control member 27 is increased (ends 27*a* and 27*b* of the control ring 27 are brought closer together) the force transmitted through the plurality of load transfer members 28 to discontinuous portion 26 increases and results in discontinuous portion 28 moving radially inward towards the centerline X with the resultant movement of the plurality of blade track segments 29 (FIG. 2). In one aspect, the discontinuous portion 26 is moved a substantially uniform amount radially over it's circumference as the load on the discontinuous portion 26 changes. In the embodiments where inner structure 23 includes fore hoop continuous portion 24 and aft hoop continuous portion 25 that are disposed around discontinuous portion 26 (FIG. 2) the movement of discontinuous portion 26 is such that there is no substantial tilting of blade track segments 29.

With reference to FIG. 4*a*, there is depicted an illustrative sectional view of a system for controlling blade tip clearance. The pair of actuators 22 is coupled to outer case/mechanical housing 20 and is rotatable to change the tension in split control member 27. As the ends 27*a* and 27*b* are moved, the gap represented by 'Z' is changed. Upon the gap represented by 'Z' decreasing in size the discontinuous portion 26 is moved radially inward and the length indicated by 'Y' is decreased. As the length indicated by 'Y' is decreased the clearance between tips 33*a* and the inner surface 30 is decreased (FIG. 2).

As the tension in split control member 27 is increased, the effective circumference of split control member 27 decreases and an increased force is asserted through the plurality of load transfer members 28 to discontinuous portion 26 of the inner structure 23. The result is that the discontinuous portion 26 and the plurality of blade track segments 29 (FIG. 2) are moved radially inward toward centerline X. In the situation where actuators 22 are actuated to decrease the tension in split control member 27, the effective circumference of split control member 27 increases and the force transmitted through the plurality of load transfer members 28 to discontinuous portion 26 decreases. Therefore, discontinuous portion 26 and the plurality of blade track segments 29 are moved radially outward away from the centerline X, thereby increasing the blade tip clearance. As disclosed herein, blade tip clearance is defined as the clearance between tip 33*a* of turbine blade 33 and inner surface 30 of blade track segment 29.

Figure 5:
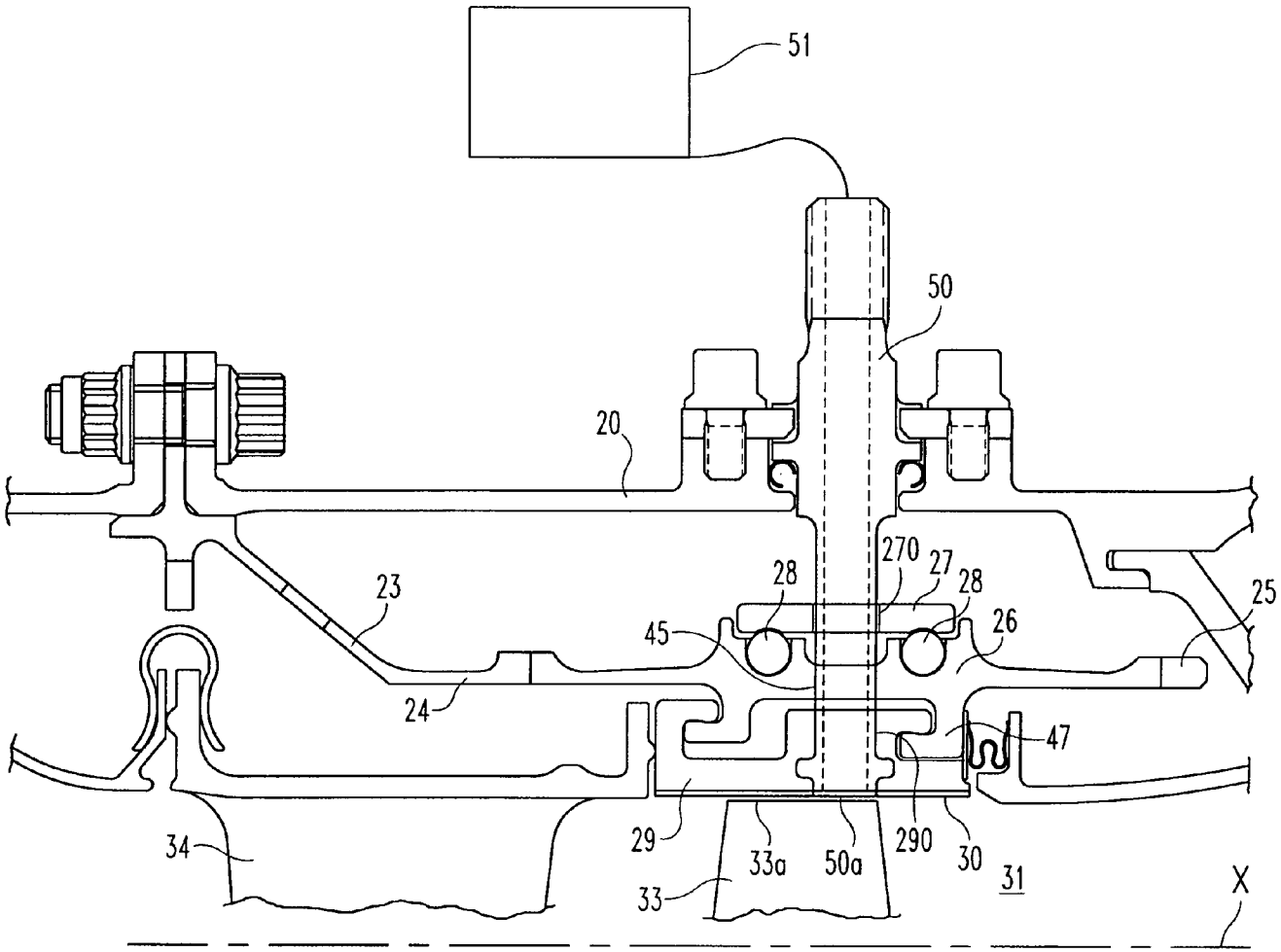
FIG. 5 is another sectional view in a rotated plane of the blade tip clearance control system of the preset invention illustrating a probe comprising a portion of the active blade tip clearance control system of FIG. 2.

With reference to FIG. 5 there is illustrated a sectional view taken in a rotated plane of the active blade tip clearance control system. The text regarding FIG. 5 focuses upon probe 50 which is mounted to outer case/mechanical housing 20 and passes through opening 270 in split control member 27, hole 45 in inner structure 23 and opening 290 in blade track segment 29. A distal end 50*a* of probe 50 is exposed to tip 33*a* of turbine blade 33 and is operable to determine the clearance between tip 33*a* and inner surface 30 of blade track segment 29. Probe 50 is operably connected to a controller 51 which utilizes the signals/data from the probe 50 to determine the clearance between tip 33*a* and inner surface 30. The blade tip clearance is then utilized to control an actuator mechanism 60 (FIG. 6) which adjusts the position of the actuators 22. Actuators 22 function to control the tension in split control member 27 by changing and/or maintaining the relative spacing between ends 27*a* and 27*b* of split control member 27 (FIG. 4). In one form the probe is a microwave sensor. However, other types of proximity probes or sensors are contemplated herein.

Figure 6:
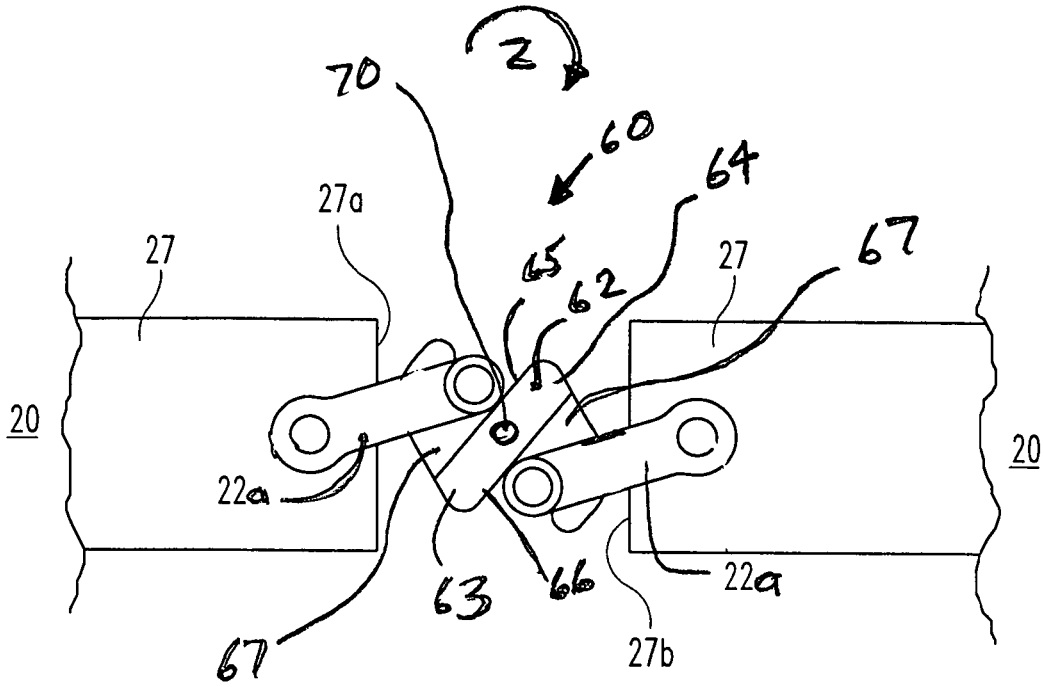
FIG. 6 is an illustrative plan view illustrating a portion of an actuator system for controlling the movement of the actuator arms of one embodiment of the present invention.
Figure 7:
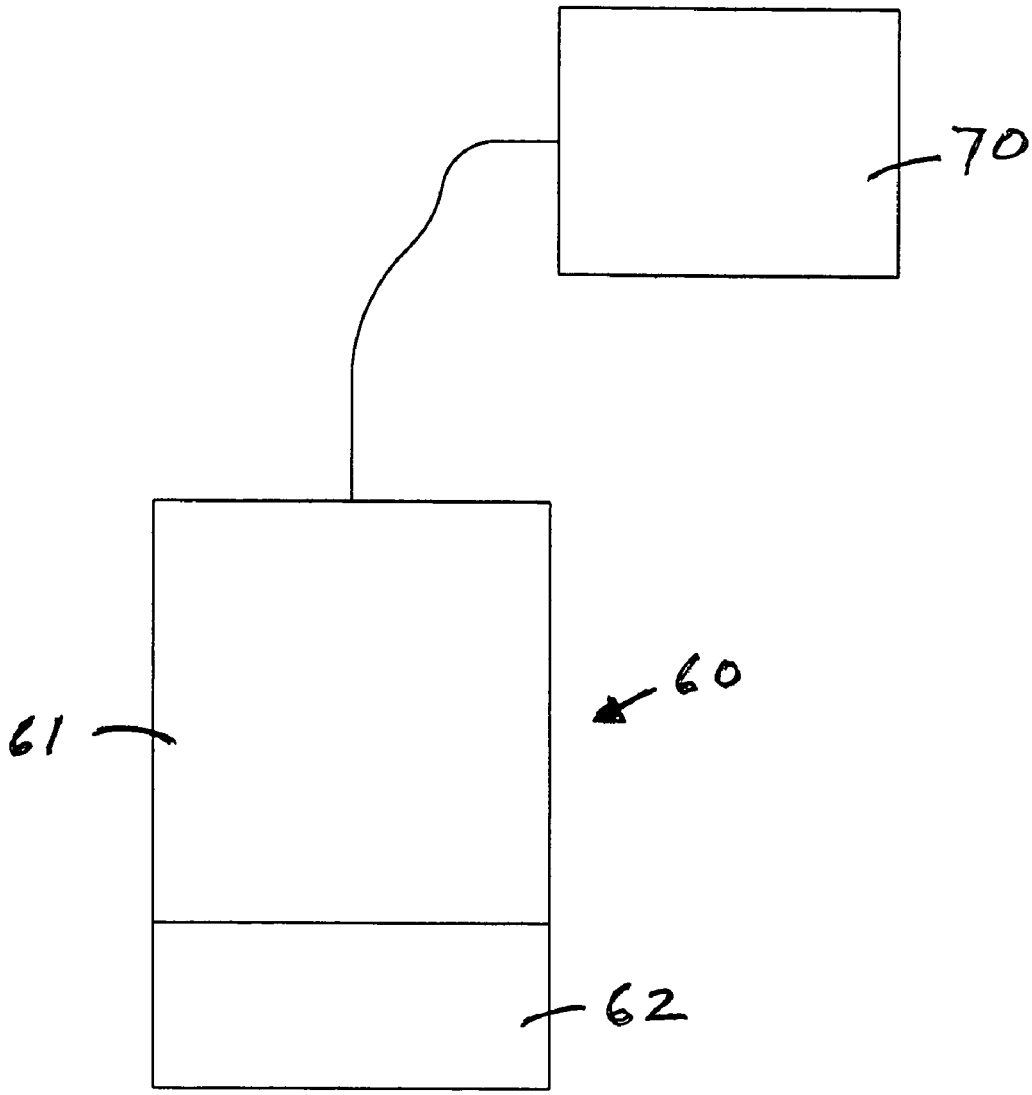
FIG. 7 is a schematic view of an actuator system for controlling the movement of the actuator arms of one embodiment of the present invention.

With reference to FIGS. 6 and 7, there is illustrated one embodiment of mechanical actuation system 60 for controlling the movement of the connecting arms 22*a*. The present application contemplates that mechanical actuation system 60 can include a hydraulic, pneumatic, electric or other type of actuator. In one embodiment the mechanical actuation system 60 includes a rotary actuator 61, and in one form the rotary actuator 61 is an electric motor. The rotary actuator 61 is operable to rotate the drive mechanism 62 and move the connecting arms 22*a*.

One form of the drive mechanism 62 includes a main body 63 having an engaging portion 64 with sidewall portions 65 and 66 that abut the connecting arms 22*a*. A guide portion 67 is disposed below the connecting arms 22*a*. In one form connecting arms 22*a* slide across the surface of the guide portion 67 as the drive mechanism 62 is rotated. In another form the guide portion 67 is normally spaced from the bottom surface of the connecting arms 22*a* but functions to limit the distance between the connecting arms 22*a* and the drive mechanism 62.

In one embodiment the drive mechanism 62 is coupled to the rotary actuator 61 through a shaft 70. The shaft 70 in one form is the output shaft of the rotary actuator 61. As the rotary actuator 61 is operated the shaft 70 is rotated and sidewall portions 65 and 66 engage and move the connecting arms 22*a* in a clockwise or counterclockwise direction of rotation. In one example the drive mechanism 62 is rotated in a clockwise direction as indicated by arrow "Z" and sidewall portions 65 and 66 are moved to allow the ends 27*a* and 27*b* of the split control member 27 to be brought closer together. Rotation of the drive mechanism 62 in the opposite direction (counterclockwise) moves the ends 27*a* and 27*b* of the split control member 27 further apart. In one form a controller 70 is utilized to control the rotary actuator 61.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a mechanical housing;

an annular member coupled to and disposed within said mechanical housing, said annular member including a segmented portion positioned between a fore hoop continuous portion and an aft hoop continuous portion;

a plurality of blade tracks coupled to and moveable with said segmented portion, each of said plurality of blade tracks having a surface that defines a portion of a working fluid flow path;

a rotatable structure including a plurality of blades disposed within said working fluid flow path, each of said plurality of blades having a blade tip spaced from said surface of the plurality of blade tracks to define a blade tip clearance;

a split control ring located within said mechanical housing and extending around said annular member;

at least one actuator coupled with said mechanical housing and said split control ring;

a plurality of load transfer members located between and abutting said annular member and said split control ring; and said at least one actuator being operable to place the split control ring in tension and transmit a force through the plurality of load transfer members to said segmented portion and move said segmented portion and the plurality of blade tracks.

2. The apparatus of claim 1, wherein said at least one actuator includes an arm connected with said split control ring, and wherein the actuation of said at least one actuator causes the arm to move and change the spacing between a first end of the split control ring and a second end of the split control ring.

3. The apparatus of claim 1, wherein said split control ring includes a first end and a second end;

wherein said at least one actuator includes two actuators, each of the actuators having an arm connected with one of the ends of the split control ring; and wherein said actuators are coupled with an actuation system that is operable to cause said arms to move and change the position of said first end and said second end.

4. The apparatus of claim 1, which further includes a sensor for determining the blade tip clearance, and wherein said at least one actuator is operable in response to said sensor to at least partially control blade tip clearance.

5. The apparatus of claim 1, wherein the force transmitted to said segmented portion caused at least a portion of said segmented portion to be deflected.

6. The apparatus of claim 1, wherein said surface is located in a first position before being moved by the force applied to said segmented portion and said surface is located in a second position after the force has been applied, and the surface when in said first position is parallel to the surface in said second position.

7. The apparatus of claim 1, wherein said segmented portion includes a plurality of circumferentially spaced segments, each of the plurality of circumferentially spaced segments are spaced from and moveable independently of adjacent segments.

8. The apparatus of claim 1, wherein said segmented portion defines a deflectable circumferential region.

9. The apparatus of claim 8, wherein said split control ring includes a plurality of first races for receiving the load transfer members and said annular member includes a plurality of second races for receiving the load transfer members, and wherein each of the plurality of load transfer members having a part in said first race and another part in said second race.

10. A method for controlling blade tip clearance within a gas turbine engine, comprising:

determining a clearance between a tip of a blade and a surface defining a portion of a working fluid flow path;

adjusting the tension in a split control ring located within the gas turbine engine;

transmitting a force from the split control ring to a discontinuous annular member;

moving at least a portion of the discontinuous annular member from a first position to a second position in response to said transmitting; and changing the position of a plurality of blade tracks in response to said moving.

11. The method of claim 10, wherein said adjusting includes changing the spacing between the ends of the split control ring.

12. The method of claim 10, wherein the discontinuous annular member is a segmented annular member.

13. The method of claim 10, wherein said determining includes sensing the clearance between the tip of the plurality of blades and the surface.

14. An apparatus comprising:

a mechanical housing;

an annular member coupled to and disposed within said mechanical housing, said annular member including an actuatable portion;

a plurality of blade tracks coupled to and moveable with said actuatable portion, each of said plurality of blade tracks having an inner surface that comprises a portion of a fluid flow path;

a rotatable structure including a plurality of blades disposed within said fluid flow path, each of said plurality of blades having a blade tip spaced from said inner surface of the plurality of blade tracks to define a blade tip clearance;

a split band located within said mechanical housing and extending around said annular member said split band operable to move said actuatable portion and change the blade tip clearance;

wherein said actuatable portion is defined by a segmented region including a plurality of spaced segments; and wherein said annular member includes a fore hoop continuous portion and an aft hoop continuous portion, and wherein said segmented region is disposed between and connected with said fore hoop continuous portion and said aft hoop continuous portion.

15. The apparatus of claim 14, wherein said actuatable portion includes a deflectable circumferential region;

which further includes a plurality of load transmission balls; and wherein said actuatable portion is coupled to said split band by said plurality of load transmission balls.

16. The apparatus of claim 15, wherein said split band includes a plurality of first races for receiving the load transmission balls and said actuatable portion includes a plurality of second races for receiving the load transmission balls, and wherein each of the plurality of load transmission balls have a part in said first race and a second part in said second race.

17. An apparatus comprising:

a mechanical housing;

an annular member coupled to and disposed within said mechanical housing, said annular member including an actuatable portion;

a plurality of blade tracks coupled to and moveable with said actuatable portion, each of said plurality of blade tracks having an inner surface that comprises a portion of a fluid flow path;

a rotatable structure including a plurality of blades disposed within said fluid flow path, each of said plurality of blades having a blade tip spaced from said inner surface of the plurality of blade tracks to define a blade tip clearance;

a split band located within said mechanical housing and extending around said annular member said split band operable to move said actuatable portion and change the blade tip clearance; and wherein said actuatable portion defines a substantially radially deflectable region, and wherein said annular member includes at least one hoop continuous region connected with said actuatable portion.

18. The apparatus of claim 17, wherein said split control ring includes a first end and a second end;

wherein said at least one actuator includes two actuators, each of the actuators having an arm connected with one of the ends of the split control ring; and wherein said actuators are coupled with an actuation system that is operable to cause said arms to move and change the position of said first end and said second end; which further includes a sensing device for determining the blade tip clearance; wherein said actuators being operable in response to said sensing device to at least partially control the blade tip clearance; and wherein the force transmitted to said segmented portion caused at least a portion of said segmented portion to be deflected.

19. An apparatus comprising:

a mechanical housing;

an annular member coupled to and disposed within said mechanical housing, said annular member including an actuatable portion;

a plurality of blade tracks coupled to and moveable with said actuatable portion, each of said plurality of blade tracks having an inner surface that comprises a portion of a fluid flow path;

a rotatable structure including a plurality of blades disposed within said fluid flow path, each of said plurality of blades having a blade tip spaced from said inner surface of the plurality of blade tracks to define a blade tip clearance;

a split band located within said mechanical housing and extending around said annular member said split band operable to move said actuatable portion and change the blade tip clearance;

wherein said actuatable portion includes a deflectable circumferential region;

a plurality of load transmission balls; and wherein said actuatable portion is coupled to said split band by said plurality of load transmission balls.

20. The apparatus of claim 19, wherein said split band includes a plurality of first races for receiving the load transmission balls and said actuatable portion includes a plurality of second races for receiving the load transmission balls, and wherein each of the plurality of load transmission balls have a part in said first race and a second part in said second race.

* * * * *